US010201789B2

(12) United States Patent
Ishida et al.

(10) Patent No.: US 10,201,789 B2
(45) Date of Patent: Feb. 12, 2019

(54) DISPERSING DEVICE, A DISPERSING SYSTEM, AND A PROCESS FOR DISPERSING

(71) Applicant: SINTOKOGIO, LTD., Nagoya-shi, Aichi (JP)

(72) Inventors: Yuu Ishida, Toyokawa (JP); Yutaka Hagata, Toyokawa (JP)

(73) Assignee: SINTOKOGIO, LTD., Aichi (JP)

( * ) Notice: Subject to any disclaimer, the term of this patent is extended or adjusted under 35 U.S.C. 154(b) by 290 days.

(21) Appl. No.: 15/106,104

(22) PCT Filed: Aug. 12, 2014

(86) PCT No.: PCT/JP2014/071267
§ 371 (c)(1),
(2) Date: Jun. 17, 2016

(87) PCT Pub. No.: WO2015/037377
PCT Pub. Date: Mar. 19, 2015

(65) Prior Publication Data

US 2016/0346749 A1 Dec. 1, 2016

(30) Foreign Application Priority Data

Dec. 27, 2013 (JP) ..... 2013-271128
May 15, 2014 (JP) ..... 2014-101090

(51) Int. Cl.
*B01F 7/00* (2006.01)
*B01F 13/10* (2006.01)
(Continued)

(52) U.S. Cl.
CPC ..... *B01F 13/1027* (2013.01); *B01F 3/1221* (2013.01); *B01F 7/00266* (2013.01);
(Continued)

(58) Field of Classification Search
CPC ..... B01F 7/00791; B01F 7/00833
(Continued)

(56) References Cited

U.S. PATENT DOCUMENTS 4,917,834 A 4/1990 Hadermann et al.
2011/0268659 A1* 11/2011 Hassan ..... B01F 7/00766 424/9.3
(Continued)

FOREIGN PATENT DOCUMENTS

JP 4-503471 6/1992
JP 7-100352 4/1995
(Continued)

OTHER PUBLICATIONS

International Search Report issued by the Japanese Patent Office in International Application No. PCT/JP2014/071267, dated Nov. 25, 2014 (2 pages).
(Continued)

*Primary Examiner* — David L Sorkin
(74) *Attorney, Agent, or Firm* — Finnegan, Henderson, Farabow, Garrett & Dunner, LLP

(57) ABSTRACT

To provide a dispersing device that carries out an appropriate dispersion having a good yield, processing within an appropriate temperature range, and having a high power to disperse. The dispersing device disperses a mixture that is slurry or a liquid by causing the mixture to flow between a rotor and a stator toward the outer circumference by centrifugal force. It comprises a container, a cover assembly that closes an upper opening of the container, a stator that is fixed under the cover assembly, a rotor that is disposed to face the lower surface of the stator, a rotary shaft that rotates the rotor, a bearing that is located above the stator, and a spacer that is detachably disposed between the rotary shaft and the rotor to adjust a gap between the rotor and the stator.

17 Claims, 10 Drawing Sheets

(51) Int. Cl.

| | |
|---|---|
| ***B01F 7/16*** | (2006.01) |
| ***B01F 3/12*** | (2006.01) |
| ***B01F 7/18*** | (2006.01) |
| ***B01F 7/24*** | (2006.01) |
| ***B01F 15/06*** | (2006.01) |

(52) U.S. Cl.
CPC ..... *B01F 7/00775* (2013.01); *B01F 7/00958* (2013.01); *B01F 7/162* (2013.01); *B01F 7/18* (2013.01); *B01F 7/24* (2013.01); *B01F 15/068* (2013.01); *B01F 2003/125* (2013.01); *B01F 2015/061* (2013.01)

(58) Field of Classification Search
USPC ..... 366/264, 286, 302, 305
See application file for complete search history.

(56) References Cited

U.S. PATENT DOCUMENTS

2013/0315030 A1* 11/2013 Ishida ..... B01F 3/1221 366/153.3
2014/0177383 A1* 6/2014 Porep ..... B01F 7/00816 366/286
2014/0192614 A1* 7/2014 Kamiya ..... B01F 5/10 366/302
2014/0356512 A1* 12/2014 Gupta ..... A23D 9/05 426/602

FOREIGN PATENT DOCUMENTS

| | | |
|---|---|---|
| JP | 2000-153167 | 6/2000 |
| JP | 2008-178823 | 8/2008 |
| JP | 2012-200715 | 10/2012 |
| JP | 2013-193033 | 9/2013 |
| WO | WO 2007/125588 A1 | 11/2007 |

OTHER PUBLICATIONS

Office Action for corresponding Chinese Application No. 201480000893.8 dated May 24, 2017.

* cited by examiner (a)

(b)

(c)

DISPERSING DEVICE, A DISPERSING SYSTEM, AND A PROCESS FOR DISPERSING

TECHNICAL FIELD

The present invention relates to a dispersing device, a dispersing system, and a process for dispersing that disperse substances in a mixture that is slurry or a liquid.

BACKGROUND ART

Conventionally, a dispersing device has been known that has a rotor that rotates at a high speed and a stationary stator. It continuously disperses liquids or powdery substances in a slurry by means of a high shearing force that is generated by the rotor and stator when the liquids or the slurry flows through a narrow gap between the rotor and stator (for example, see Japanese Patent Laid-open Publication No. 2000-153167). The term "disperse" used herein means to make powdery substances in a slurry finer and make them be uniformly distributed, to make powdery substances in a slurry be uniformly distributed, or to mix a plurality of liquids to cause them to be homogeneous.

The dispersing device that is disclosed in that publication disperses the liquids or the powdery substances in the slurry by means of a shearing force that is generated between the rotor and stator. By the conventional device the power to disperse cannot be adjusted, and so it is difficult to obtain a suitable dispersion.

For example, if the power to disperse is low, an intended dispersed state cannot be achieved or the process takes too much time. However, if the viscosity of a mixture is too high, the power to disperse the mixture must be so high that the temperature of the mixture rises too much. Further, when a mixture with a high viscosity is dispersed by a conventional dispersing device some of the mixture remains in the device, so that the yield becomes worse.

The purpose of the present invention is to provide a dispersing device, a dispersing system, and a process for dispersing that achieve an appropriate dispersion, such as having a good yield, such as processing within an appropriate temperature range, and such as having a high power to disperse.

DISCLOSURE OF INVENTION

The dispersing device of the present invention is a shear-type device. It disperses a mixture of a slurry or a liquid by causing it to flow by centrifugal force toward the outer circumference between a rotor and a stator that is disposed to face the rotor. It comprises a container for receiving the dispersed mixture, a cover assembly that closes an upper opening of the container, a stator that is fixed under the cover assembly, a rotor that is disposed to face the lower surface of the stator, a rotary shaft that rotates the rotor, a bearing that is disposed in the cover assembly and is located above the stator to rotatably hold the rotary shaft, and a spacer that is detachably disposed between the rotary shaft and the rotor to adjust a gap between the rotor and the stator. When the spacer is disposed the axial position of the rotor in relation to the stator is fixed.

The dispersing system of the present invention comprises the above-mentioned dispersing device, a tank for storing a mixture before a process that stores the mixture to be supplied to the dispersing device, a tank for storing a mixture after the process that stores the mixture that has been processed by the dispersing device, a first piping that connects the dispersing device with the tank for storing the mixture before the process, and a second piping that connects the dispersing device with the tank for storing the mixture after the process. The mixture that has been stored in the tank for storing the mixture before the process is processed by the dispersing device and the mixture that has been processed is supplied to the tank for storing the mixture after the process.

Further, the process for dispersing of the present invention uses the above-mentioned dispersing device and disperses the mixture by supplying it between the rotor and stator and causing the mixture to flow toward the outer circumference by centrifugal force.

By the dispersing device, by the dispersing system, or by the process for dispersing of the present invention, dispersing a mixture can be carried out at a high yield, at a high power to disperse, and within an appropriate temperature range. Namely, an appropriate dispersion can be achieved.

The basic Japanese patent applications, No. 2013-271128. filed Dec. 27, 2013. and No. 2014-101090. filed May 15, 2014. are hereby incorporated by reference in their entireties in the present application.

The present invention will become more fully understood from the detailed description given below. However, the detailed description and the specific embodiments are only illustrations of the desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

BEST MODE FOR CARRYING OUT THE INVENTION

Below, the shear-type dispersing device of the present invention is discussed with reference to the drawings. The shear-type dispersing device to be discussed circulates and disperses a slurry mixture (called a "solid-liquid dispersion" or "slurrying") or circulates and disperses a mixture of liquids (called a "liquid-liquid dispersion" or "emulsifying"). The term "disperse" means to make substances in the mixture be uniformly distributed or make them finer and be uniformly distributed. Namely, it means to mix each kind of substance in the mixture so that it is uniformly distributed.

Figure 1:
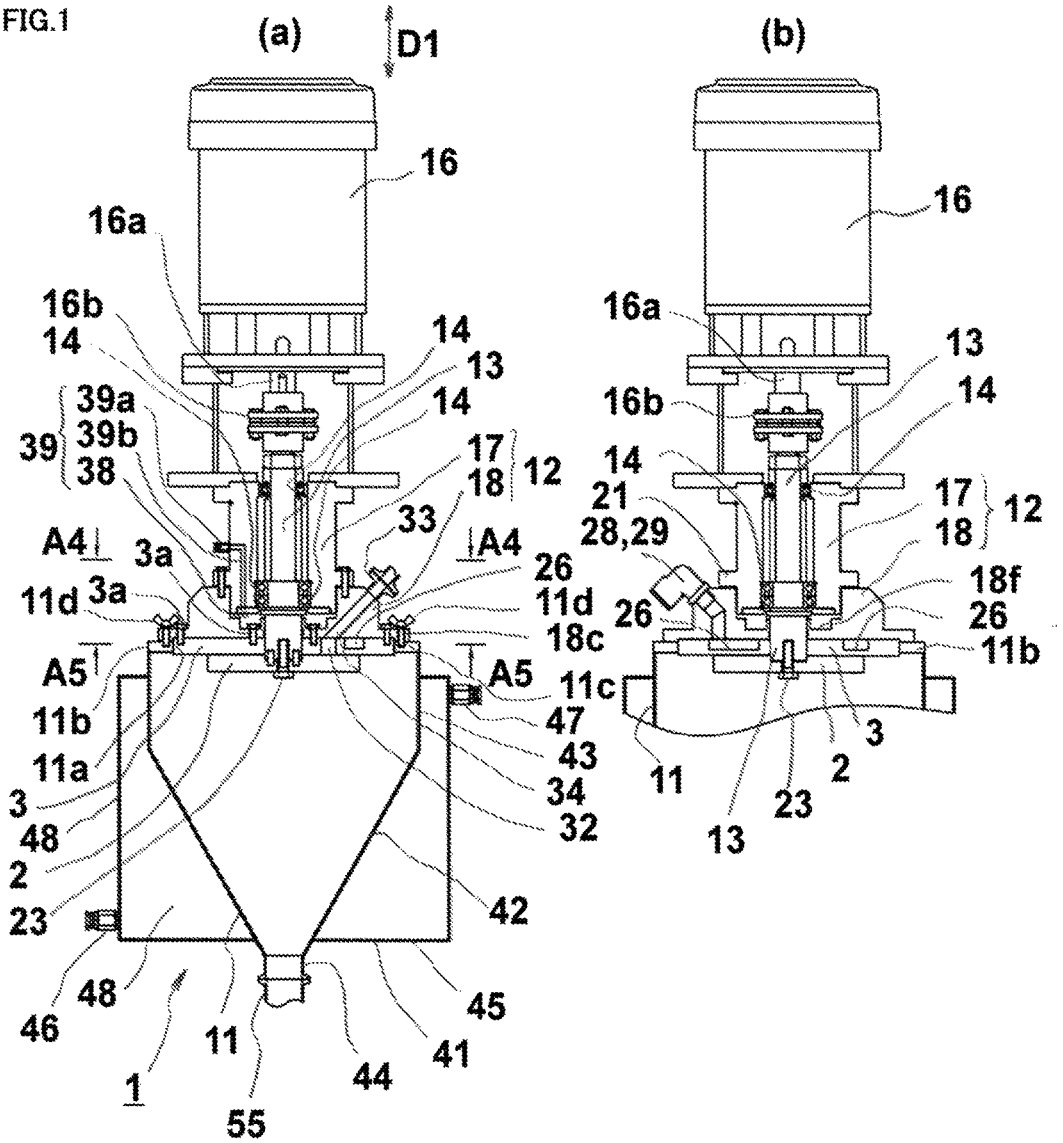
FIG. 1 shows schematic sectional drawings of the dispersing device of the present invention. Figure (a) shows a cross section taken along the line A1-A1 in FIG. 2. Figure (b) shows a cross section taken along the line A2-A2 in FIG. 2 and a cross section taken along the line A3-A3 in FIG. 2, but the lower part is omitted.
Figure 2:
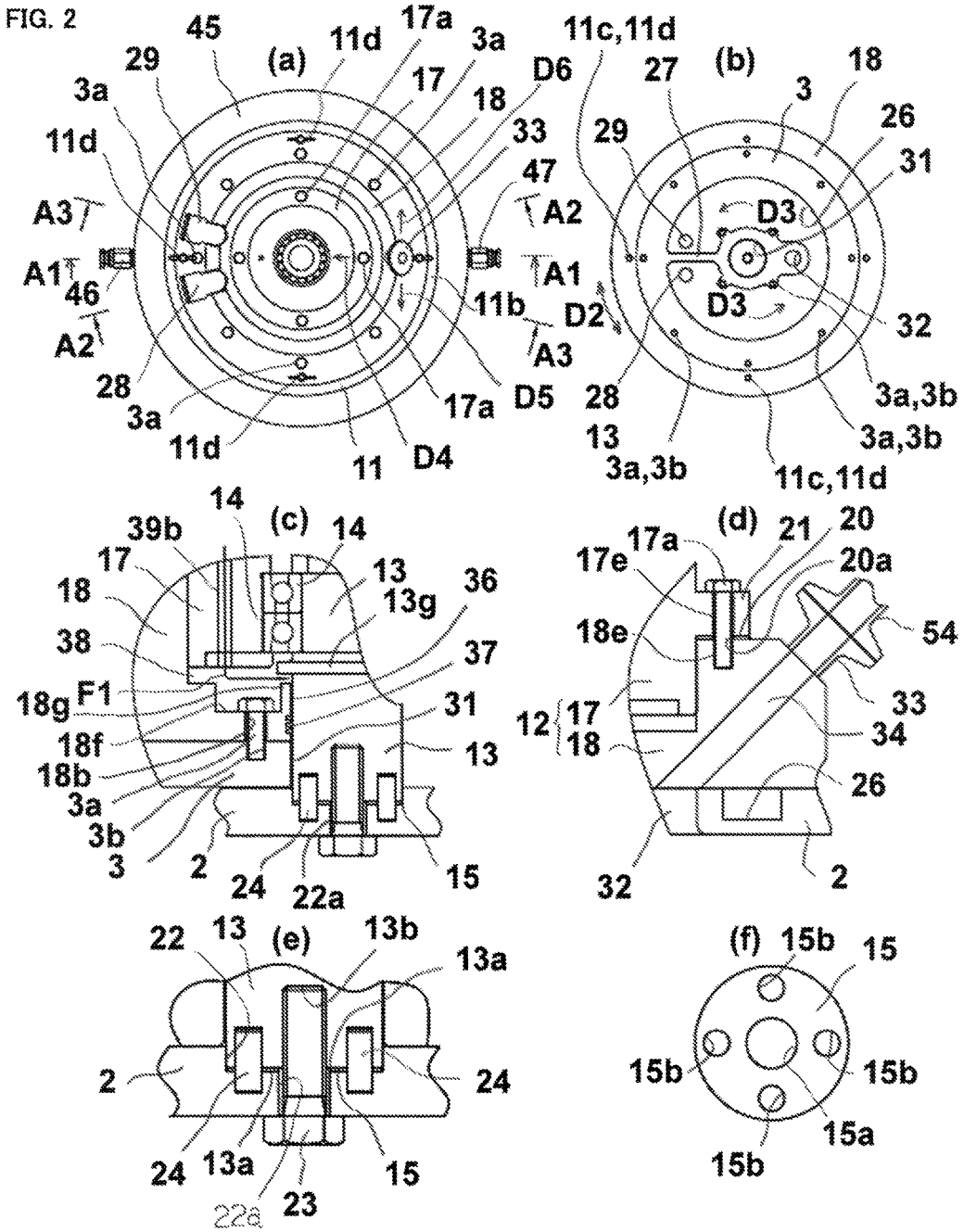
FIG. 2 illustrates the details of the dispersing device in FIG. 1. Figure (a) shows a cross section taken along the line A4-A4 in FIG. 1. Figure (b) shows a cross section taken along the line A5-A5 in FIG. 1. Figure (c) shows enlarged major parts illustrating a spacer, a labyrinth seal that is located at a second hole for inserting the rotary shaft, and a seal by air purging. Figure (d) shows enlarged major parts illustrating a second spacer. Figure (e) shows enlarged major parts illustrating the integration by binding the rotary shaft and the rotor, and the spacer. Figure (f) shows a top view of the spacer.
Figure 3:
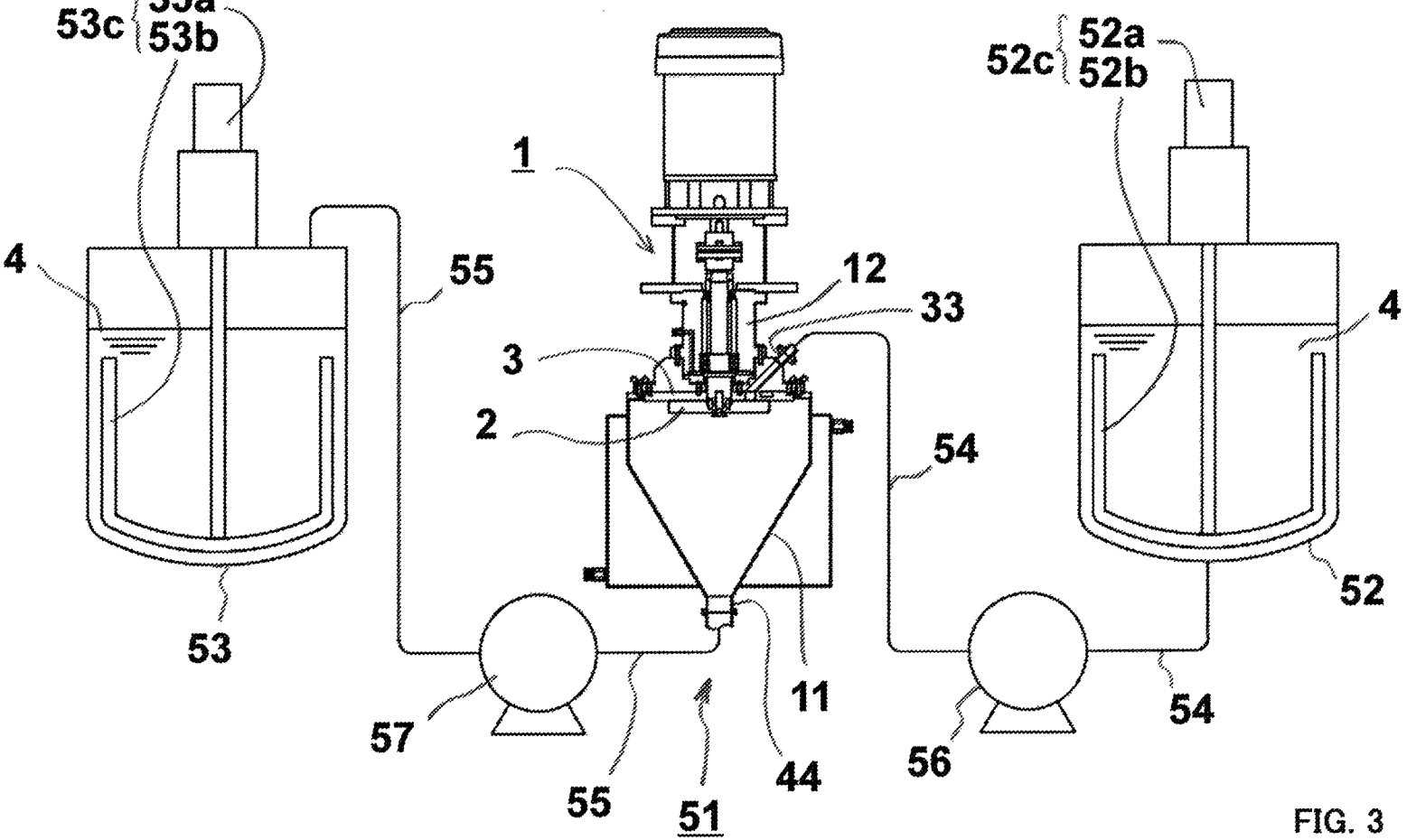
FIG. 3 is a schematic drawing of the dispersing system that uses the dispersing device in FIG. 1.

First, the shear-type dispersing device (below, "the dispersing device") 1 that is shown in FIGS. 1, 2, and 3 is discussed. The dispersing device 1 comprises a rotor 2 and a stator 3 that is disposed to face the rotor 2. It causes a slurry or liquid mixture 4 to flow between the rotor 2 and the stator 3 toward the outer circumference (toward the direction of the outer circumference) by centrifugal force to disperse it.

The dispersing device 1 comprises a container 11 for receiving the mixture 4 that has been dispersed and a cover assembly 12 for closing the upper opening 11*a* of the container 11. For example, the cover assembly 12 is fixed to the container 11 by placing bolts 11*d* through the bolt holes 11*c* in the upper rim 11*b* of the container 11 and the bolt holes 18*c* in the cover assembly 12 (a part 18 for holding the stator, which is discussed below), to close the upper opening 11*a*.

The stator 3 is fixed under the cover assembly 12 (to the lower surface of the cover assembly 12). For example, the stator 3 is fixed there by placing bolts 3*a* through the bolt holes 3*b* in the stator 3 and the bolt holes 18*b* in the cover assembly 12 (the part 18 for holding the stator). The rotor 2 is disposed to face the lower surface of the stator 3.

The dispersing device 1 further comprises a rotary shaft 13 that rotates the rotor 2 and a bearing 14 that rotatably holds the rotary shaft 13. The bearing 14 is fixed to the cover assembly 12 and located above the stator 3.

The rotor 2 is disposed at one end of the rotary shaft 13. At the other end a rotary shaft 16*a* of a motor 16 that is disposed above the stator 3 is fixed via a joint 16*b*. The rotary shaft 13 is rotated by means of the motor 16 and transmits the force for rotation by the motor 16 to the rotor 2.

The dispersing device 1 comprises a spacer 15 that is detachably disposed between the rotary shaft 13 and the rotor 2 (see FIG. 2*c* and FIG. 2*e*). The spacer 15 causes the gap between the rotor 2 and the stator 3 to be adjusted by being replaced by another one that has a different length (thickness) in the direction of the dispersing device 1, i.e., the axial direction D1 of the rotary shaft 13. That is, spacers 15 that have various thicknesses are stocked so as to adjust the gap between the rotor 2 and the stator 3 by using one of them.

When the spacer 15 is disposed, the position of the rotor 2 in relation to the stator 3 in the axial direction D1 is fixed. That is, a spring or a screw may be used to adjust the gap between the rotor 2 and the stator 3. However, when the spacer 15 is used, since the axial position of the rotor 2 is fixed during the operation, no countermeasures against vibrations by the spring or looseness by the screw need be considered. Further, if a spring or a screw is used, it is difficult to accurately move the rotor 2 without the rotor 2 being inclined. On the contrary, when the spacer 15 is used the rotor can be accurately moved without it being inclined.

By the dispersing device 1, the gap can accurately be adjusted by means of the above-mentioned structure. By the dispersing device 1, even if the rotary shaft 13 is thermally expanded due to unforeseen heat, the rotor 2 moves in the direction to be separated from the stator 3. Thus any contact between the rotor 2 and the stator 3 can be prevented. Further, producing excessive heat due to an unforeseen small gap, even though they do not contact each other, can be prevented. Further, since the bearing 14 is located above the stator 3, the rotary shaft 13 is located over the rotor 2. Since no part of the rotary shaft 13 is disposed under the rotor 2 (the rotary shaft 13 is upwardly disposed from the rotor 2), a reduction in the yield due to adhesion of the processed mixture 4 on the rotary shaft 13, the bearing 14, etc., can be prevented. Namely, the yield can be improved.

The cover assembly 12 has a part 17 for holding the bearing 14 and the part 18 for holding the stator that is disposed under the part 17. The part 18 holds the stator 3. The part 17 for holding the bearing has a part 21 for controlling the axial position of the part 18 for holding the stator. The part 21 abuts the part 18 by means of a second spacer 20. For example, the part 17 is integrated with the part 18 by placing bolts 17*a* through the bolt holes 17*e* in the part 17 and the bolt holes 18*e* in the part 18 while the second spacer 20 is sandwiched between them (see FIG. 2*d*). Through-holes 20*a* are formed in the second spacer 20 so that the bolts 17*a* pass through them.

The second spacer 20 is detachably disposed between the part 17 for holding the bearing and the part 18 for holding the stator. It adjusts the position of the stator 3 in the axial direction D1 in relation to the part 17 by being replaced by another one that has a different length (thickness) in that direction D1. That is, the second spacers 20 that have various thicknesses are stocked so as to adjust the position of the stator 3 in the axial direction D1 by using one of them.

By replacing the spacer (also called "the first spacer") 15 and the second spacer 20 with respective spacers, the gap between the rotor 2 and the stator 3 can be more precisely adjusted. That is, by replacing the spacer 15 with a thicker one, that gap becomes larger. By replacing the second spacer 20 with a thicker one, that gap becomes smaller. A combination of these replacements can achieve a more precise adjustment. For example, the spacers 15 and the second spacers 20 that have thicknesses from 0.01 mm to 0.50 mm in increments of 0.01 mm are stocked. They are replaced so that the gap between the rotor 2 and the stator 3 is adjusted to suit the viscosity and properties of the mixture 4.

The second spacer 20 causes the position of the stator 3 to be adjusted in relation to the part 17 for holding the bearing, i.e., the position of the lower surface of the stator 3, by the position of the part 18 for holding the stator in relation to the part 17 for holding the bearing being adjusted. Thus the position of the lower surface of the stator 3 can be kept constant regardless of the condition of the stator 3. For example, even when the stator 3 is replaced, the position of the lower surface of the stator 3 can be kept constant. Thus, for example, by keeping the position of the lower surface of the stator 3 at a predetermined position, the thickness of the spacer 15 can be the same as the gap between the rotor 2 and the stator 3, so that the structure is comprehensible to users. That is, to adjust the gap at a desired distance the spacer 15 that has the same thickness as the gap has to be chosen. This improves the convenience for the users who perform the dispersing process under the control of the gap.

A concave part 22 is formed on the upper surface of the rotor 2 so that the lower end 13*a* of the rotary shaft 13 is inserted into it (see FIGS. 2*c* and 2*e*). A through-hole 22*a* that opens on the concave part 22 is formed in the rotor 2. The lower end 13*a* of the rotary shaft 13 is inserted into the concave part 22 of the rotor 2. The lower end 13*a* abuts the concave part 22 by means of the spacer 15. A fastening member 23 is fixed from the lower side of the rotor 2. The fastening member 23 is, for example, a bolt. In the lower end 13*a* of the rotary shaft 13 a female screw, as a fastening part 13*b* that is a counterpart of the fastening member 23, is formed.

The fastening member 23 fastens the rotary shaft 13 to the rotor 2 across the spacer 15 by fixing a part of it to the rotary shaft 13 through the hole 22*a* of the rotor 2. Pins 24 are inserted into the concave part 22 of the rotor 2 and the lower end 13*a* of the rotary shaft 13 to transmit the rotational power of the rotary shaft 13 to the rotor 2. Holes for receiving the pins 24 are formed in the concave part 22 of the rotor 2 and the lower end 13*a* of the rotary shaft 13.

The pins 24 are disposed at a uniform interval along the circumferential direction to transmit the rotational power of the rotary shaft 13 to the rotor 2. A first through-hole 15*a* through which the fastening member 23 passes and second through-holes 15*b* through which the pins 24 pass are formed in the spacer 15. In this embodiment four second through-holes 15*b* and four pins 24 are used. However, the number is not limited to four.

Since the rotary shaft 13 and the rotor 2 are fastened across the spacer 15 by the fastening member 23, the axial position of the rotor 2 in relation to the stator 3 is definitely fixed. Thus the gap between the rotor 2 and the stator 3 can be made appropriate. That is, the spacer 15 with the above-mentioned advantages is properly used.

Since the pins 24 are used for transmitting the rotational power from the rotary shaft 13 to the rotor 2, the distribution of the power in the circumferential direction is improved in comparison with a structure in which a key and a keyseat are used. That is, the rotary shaft 13 and the rotor 2 rotate in a balanced way. Thus the dispersing power between the rotor 2 and the stator 3 is prevented from differing at different locations. That is, a uniform and appropriate dispersing process can be carried out. Since the difference in the dispersing power at different locations is prevented, the dispersing process can be stable when the gap is narrowed. Further, since the speed of the rotation can be increased, an appropriate dispersing process can be carried out.

The stator 3 is bigger than the rotor 2 on the plane where it faces the rotor 2. That is, the stator 3 on the plane perpendicular to the axial direction D1 is shaped to be larger than the rotor 2. In the stator 3 a groove 26 for cooling is formed on the surface (the upper surface) opposite the surface (the lower surface) that faces the rotor 2 so that a coolant flows through it. The groove 26 for cooling is located beyond the outer edge of the rotor 2.

Since the groove 26 for cooling is formed beyond the outer edge of the rotor 2, the outer edge of the rotor 2 can be cooled. That is, the entire areas for dispersion of the rotor 2 and the stator 3 can be cooled by the groove 26 for cooling. Thus generating heat in the material (the mixture 4 being dispersed) can definitely be prevented. Thus the material that is to be dispersed is prevented from deteriorating. Further, even if the material is volatile and flammable, the dispersing process can be safely carried out. Conventionally, the rotor 2 and the stator 3 are shaped to have the same sizes on the plane they face. In such a case the outer edge cannot be cooled. Since the amount of heat generated is high at the outer edge, the groove 26 for cooling provides an excellent cooling effect. Thus the appropriate dispersing process can be carried out at an appropriate temperature range.

A wall 27 is formed along the radial direction on the groove 26 for cooling (see FIG. 2*b*). A port 28 for supplying the coolant and a port 29 for discharging the coolant are disposed across the wall 27 on the groove 26. The coolant that is supplied from the port 28 to the groove 26 flows toward the direction D3, in which no wall 27 is formed near the port 28, in the circumferential direction D2. That coolant is discharged from the port 29. For example, the coolant can be water.

Since the groove 26 for cooling is configured to cause the coolant to flow from the port 28 for supplying the coolant to the port 29 for discharging the coolant in a single direction, namely, it ends so as to cause the coolant to flow in a single direction, the coolant is discharged in order of precedence. In other words, if it were not configured to cause the coolant to flow in a single direction, a part of the coolant would stay, so that the coolant might not be replaced by new coolant at a part of the groove for cooling, deteriorating the cooling ability. By contrast, since the groove 26 for cooling is configured to replace the coolant in order of precedence, the cooling ability is constantly high. Thus the appropriate dispersing process at the appropriate temperature can be carried out.

Figure 4:
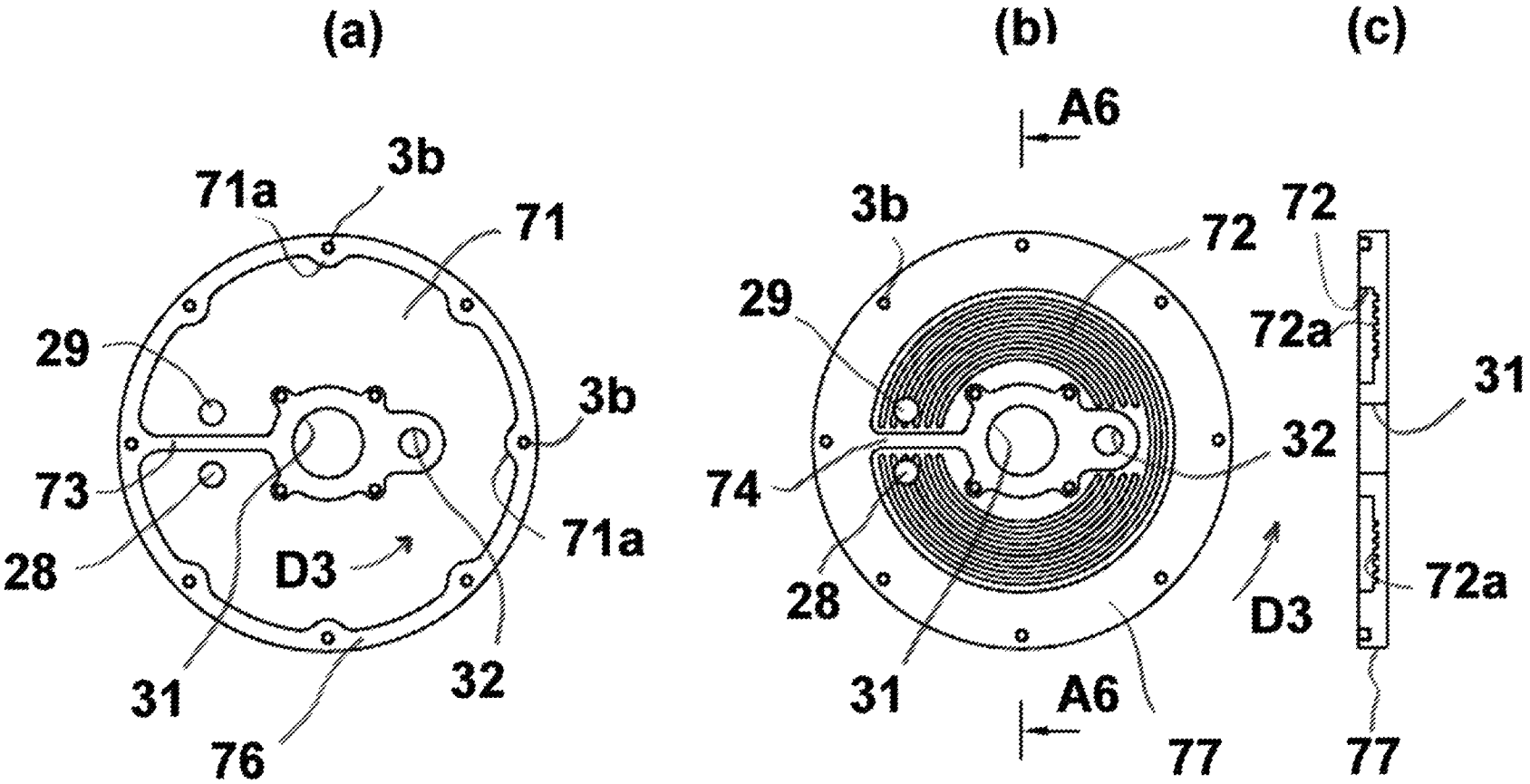
FIG. 4 illustrates a groove for cooling that is a part of the dispersing device in FIG. 1 and another example of the stator that has the groove. Figure (a) shows another example of the stator that can be used for the dispersing device in FIG. 1, which figure shows a cross section taken along the same position as in FIG. 2(*b*). Figure (b) shows yet another example of the stator that can be used for the dispersing device in FIG. 1, which shows a cross section taken along the same position as in FIG. 2(*b*). Figure (c) shows a cross section taken along the line A6-A6 in FIG. 4(*b*).

The groove for cooling and the stator, on which the groove is formed, are not limited to the above-mentioned structure. For example, as shown in FIG. 4, the stators 76, 77 with the grooves 71, 72 for cooling may be used. FIG. 4*a* illustrates an example by which the cooling ability is enhanced by widening the groove as much possible, except where the screws are located. FIG. 4*b* illustrates an example by which the cooling ability is enhanced by increasing the area to contact the coolant by forming fine grooves on the bottom of the groove. FIG. 4*c* shows a cross section taken along the line A6-A6 in FIG. 4*b* to illustrate the section of the fine grooves, or concave parts, 72*a*. Since the stators 76, 77 have the same structure and function as the stator 3 except for the groove for cooling, a duplicate explanation is omitted.

As in FIG. 4, like the groove 26 for cooling, the grooves 71, 72 for cooling are formed in the upper surfaces of the stators 76, 77, respectively, which stators are larger than the rotor 2, so as to reach outside the rotor 2. Like the wall 27, the walls 73, 74 are provided to the grooves 71, 72 for cooling. A structure that is similar to that of the groove 26 for cooling has similar functions.

Next, a structure that differs from that of the groove 26 for cooling is discussed. The groove 71 for cooling is extended to the outer edge of the stator 76. In the portions in which the bolt holes 3*b* are formed, protrusions 71*a* are formed. Since the groove 71 extends toward the outer edge, the cooling effect is enhanced. On the bottom of the groove 72 for cooling concave parts 72*a* are formed in the circumferential direction. Thereby, the amount of heat exchange between the coolant and the stator 76 increases so as to increase the cooling effect. The grooves 71, 72 have a higher cooling effect than the groove 26 does. As discussed above, when the stator that has either of the grooves 71, 72 for cooling, instead of the groove 26 for cooling, is used, a high cooling function is obtained so that an appropriate dispersing process within an appropriate temperature range is carried out.

In the stator 3 a hole 31 for inserting the rotary shaft is formed through which the rotary shaft 13 passes. The mixture 4 is supplied from outside the positions of the hole 31 of the stator 3 to the gap between the stator 3 and the rotor 2.

Specifically, a through-hole 32 for supplying the mixture 4 is formed outside the hole 31 for inserting the rotary shaft in the stator 3. In other words, the through-hole 32 is located a certain distance from the hole 31. A port 33 for supplying the mixture, and a passage 34 that communicates with the through-hole 32 for supplying the mixture to the port 33 and is provided in the stator 3, are provided in the part 18 for holding the stator. The mixture 4 that is supplied from the port 33 is introduced to the gap between the stator 3 and the rotor 2 through the passage 34 in the part 18 and the through-hole 32 in the stator 3. A flange for a connection is provided to an end of the port 33 for supplying the mixture so as to connect with a piping (the first piping 54), which is discussed below.

By this configuration, when the rotor 2 is rotated while the mixture 4 is supplied, the mixture 4 that has been supplied to the through-hole 32 is caused to flow outwardly by means of centrifugal force. Thus no mixture 4 reaches near the center of the rotation. Thus no sealing member such as a mechanical seal is required in the hole 31 for inserting the rotary shaft (also called "a first hole for inserting the rotary shaft") or a second hole 36 for inserting the rotary shaft, which second hole 36 is discussed below. Namely, the through-hole 32 is located at such a distance from the hole 31 for inserting the rotary shaft that no mixture 4 flows to the hole 31. Thus the structure of the dispersing device can be simplified. Further, no replacement of the sealing member due to deterioration is needed.

The port 33 for supplying the mixture and the passage 34 are inclined in the direction D4, toward the radial center, as they become lower. However, they may be inclined, for example, in the tangential directions D5, D6 as they become lower. The port 33 for supplying the mixture and the passage 34 are formed so that the bottom end of the passage 34 is located at a position to be connected to the through-hole 32. Thus the through-hole 32 can be located near the hole 31.

The second hole 36 for inserting the rotary shaft, through which the rotary shaft 13 is inserted, is formed in the part 18 for holding the stator. A labyrinth seal 37, which is a noncontact seal, is provided to the second hole 36. Here the labyrinth seal has a configuration that has concavo-convex gaps in series between the rotary shaft and the fixed part by forming one or multiple concave parts and/or convex parts on one or both of the sides of the rotary shaft (the rotary shaft 13) and the fixed side (the part 18 for holding the stator). Such a configuration functions as a seal. The sizes of the concave parts and the convex parts are, for example, 0.01-3.00 mm.

Air is supplied from outside the part 18 for holding the stator to a space 38 that is located within the part 18 and connected to the upper part of the second hole 36 for inserting the rotary shaft. By supplying air from outside the part 18 a seal 39 by air purging is provided. For example, the seal 39 by air purging has a space 38 that is formed by the part 17 for holding the bearing and the part 18 for holding the stator, a passage 39*b* for purging that is formed in the part 17 and that connects the space 38 to the outside, and a part 39*a* for supplying air that is provided at the outer side of the passage 39*b* to supply air for purging. The seal 39 by air purging supplies air that is supplied from the part 39*a* to the gap between the second hole 36 and the rotary shaft 31 through the passage 39*b* and the space 38 as shown by the arrow F1. This air provides the sealing function.

On the outside of the second hole 36 in the part 18 for holding the stator a concave part 18*f* is formed to receive a bolt 3*a* for fixing the stator 3 to the part 18. Since the concave part 18*f* is formed, an inner circumference 18*g* that forms the second hole 36 for inserting the rotary shaft is shaped like a projection. The rotary shaft 13 has a projection 13*g* that projects over the inner circumference 18*g* of the part 18. As shown by the arrow F1, the air that has been supplied from the part 39*a* passes through the gap between the inner circumference 18*g* and the projection 13*g* and is supplied to the gap between the second hole 36 for inserting the rotary shaft and the rotary shaft 31.

The labyrinth seal 37 enhances the sealing effect on the second hole 36 for inserting the rotary shaft. The seal 39 by air purging enhances the sealing effect on the hole 31 for inserting the rotary shaft and the second hole 36 for inserting the rotary shaft by means of purging. In the dispersing device 1 as discussed above, since the mixture 4 is introduced to such a position that centrifugal force is effectively utilized, neither a labyrinth seal nor a purging mechanism must be provided. However, one of these may be provided to enhance the sealing effect. Both may be provided to further enhance the sealing effect.

The container 11 has a conical wall 42 that has a smaller cross section from the top to the bottom, a cylindrical wall 43 that is located on the conical wall 42, and a port 44 for discharging at the lower end of the conical wall 42. The port 44 for discharging is provided at the lower end of the container 11 to discharge the mixture 4 that has been dispersed. At the end of the port 44 a flange for a connection is provided so that a piping (the second piping 55), which is discussed below, is connected to it. Since the mixture 4 after being dispersed is discharged through the conical wall 42, the amount of the mixture 4 that adheres to the inner wall and that is not discharged drastically decreases. Thus the yield is improved and an appropriate process is carried out. A vacuum pump may be provided to the container 11 so that air is prevented from being mixed in the mixture 4.

A cooling mechanism 41 that has a cooling function is provided to the container 11. For example, the cooling mechanism 41 includes the wall 42 and the wall 43 that together form the outer surface of the container 11. It also has a member 45 for forming the space that covers the outer surface (the wall 42 and the wall 43), which member is located outside the walls. It also has a port 46 for supplying a cooling medium and a port 47 for discharging a cooling medium. For example, the member 45 for forming the space may be a member that is generally called a jacket and forms a space 48 between it and the walls 42 and 43 so that a cooling medium, such as cooling water, is filled in it.

For example, the port 46 for supplying a cooling medium is provided on the lower side of the member 45 for forming the space so as to supply the cooling water to the space 48. For example, the port 47 for discharging the cooling medium is provided on the upper side of the member 45 for forming the space so as to discharge the cooling water from the space 48.

By the above configuration the cooling mechanism 41 has a function to cool the inside of the container 11 through the walls 42, 43. The cooling mechanism 41 also cools the mixture 4 that has been dispersed. If the mixture 4 includes a volatile material, the vaporized material is cooled to return to a liquid form. The structure of the cooling mechanism 41 is not limited to the above-mentioned one, but may be any known structure.

Figure 5:
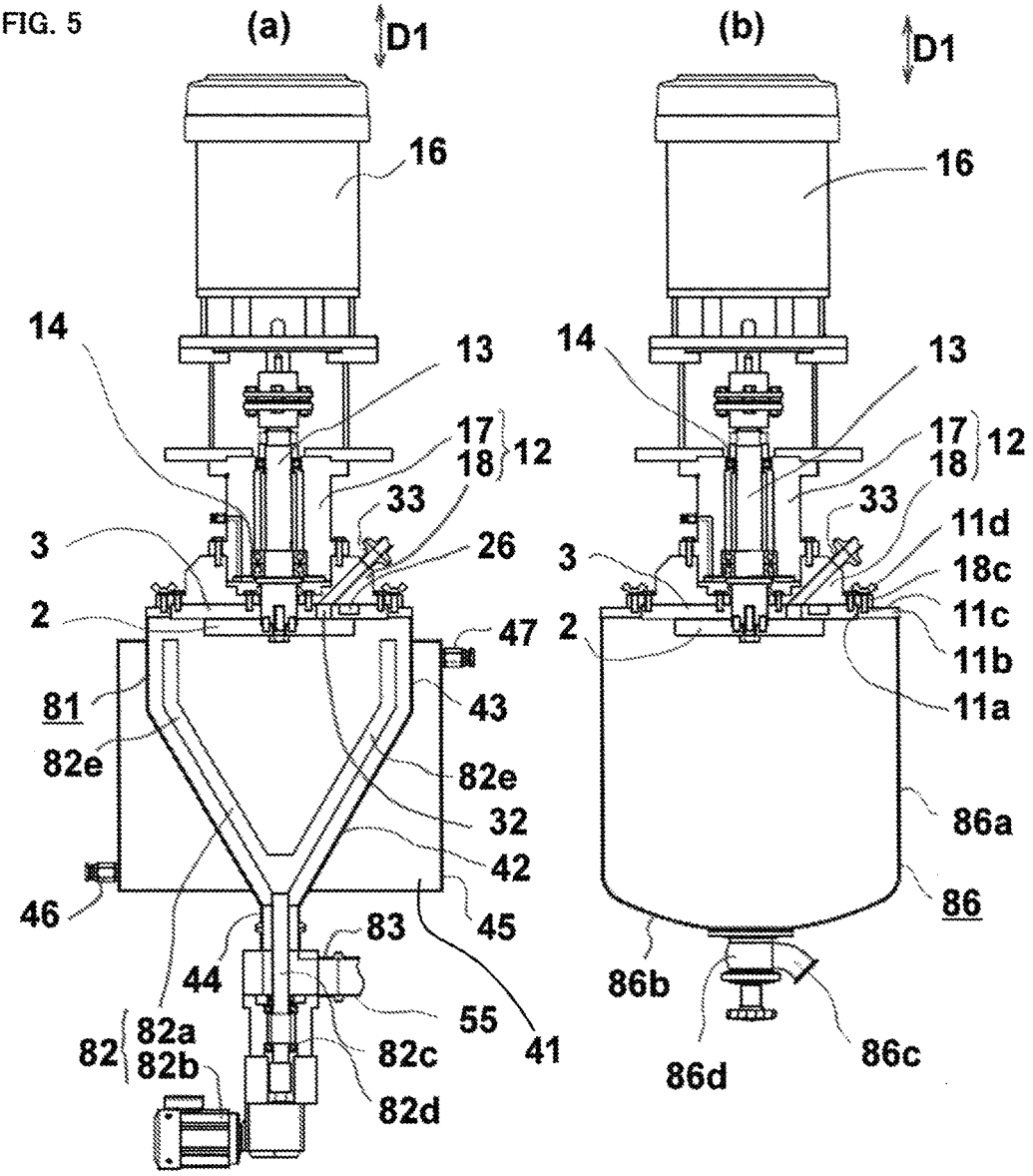
FIG. 5 illustrates another example of the container that is a part of the dispersing device in FIG. 1. Figure (a) shows the dispersing device where the container is replaced by a container having an agitating plate. Figure (b) shows the dispersing device where the container is replaced by a container that is combined with a tank for storing the mixture after the process ends.

The container that constitutes the dispersing device 1 is not limited to the container 11, but may be the containers 81, 86 as in FIG. 5. First, the container 81 as in FIG. 5*a* is discussed. The container 81 has the same structure and functions as those of the container 11 except for having an agitator 82. So a duplicate explanation is omitted.

The container 81 as in FIG. 5*a* has the walls 42, 43 and the port 44 for discharging. The container 81 is equipped with the cooling mechanism 41. The container 81 is also equipped with the agitator 82. The agitator 82 scrapes the slurry mixture 4 that adheres to the inner surfaces of the walls 42, 43. The scraped mixture 4 is discharged, together with the mixture 4 that has not adhered, from the port 44 for discharging. The agitator 82 has an agitating plate 82*a* that is shaped so as to follow the shape of the walls 42, 43 and a motor 82*b* that rotates the plate 82*a*. The agitator 82 also has a rotary shaft 82*c* and a bearing 82*d*. The agitating plate 82*a* is shaped so that the clearance between it and the walls 42, 43 is about 0-20 mm. The agitating plate 82*a* is made of metal or metal and resin. Here the agitating plate 82*a* has two agitating parts 82*e* so as to scrape at two positions on the circumference. However, it may have three or more agitating parts by combining plates, or just one agitating part. In the example shown in FIG. 5*a*, from the need to dispose the rotary shaft 82*c* the port 44 for discharging is connected to a connecting pipe 83 so as to be connected to a piping (the second piping 55) through it. Since the mixture 4 after being dispersed is discharged through the conical wall 42, the amount of the mixture 4 that adheres to the inner wall and that is not discharged drastically decreases. Further, the agitating plate 82*a* facilitates the discharge of the mixture 4. Thus the yield is improved.

Next, as another example of the container that constitutes the dispersing device 1, the container 86 as in FIG. 5*b* is discussed. The container 86 doubles as a tank for storing the mixture 4 after being dispersed. Namely, the container 86 has a cylindrical wall 86*a* and a spherical bottom 86*b* that is located under the cylindrical wall 86*a*. A port 86*c* for discharging is provided at the lower end of the bottom 86*b* with an on-off valve 86*d*.

The container 86 as in FIG. 5*b* is compatible with the mixture 4 that is completely dispersed in a single dispersion, as discussed below. For example, it is compatible with a process for dispersing a small amount of the mixture 4, that needs to be appropriately dispersed, and that is expensive. After the process for dispersing, the bolts 11*d* are removed to dismount the container 86 from the cover assembly 12, or the rotor 2 and the stator 3 that are attached to the cover assembly 12. The container 86 can be directly used as a container for transporting and be transported to a desired location. Thus the mixture 4 that would adhere to the outer surface of the dispersing device in another structure can be recovered, so that the yield is improved. The shape of the container 86, which doubles as the tank for storing the mixture after the process, is not limited to it, but may be conical. Alternatively, it may be a large tank for accepting a large amount of the mixture being dispersed, or for being, for example, divided into two parts. The container that doubles as the tank for storing the mixture after the process may be equipped with the cooling mechanism 41.

For example, a stainless steel, such as SUS304. SUS316. SUS 316L, or SUS 430. as stipulated in the Japanese Industrial Standards (JIS), or a carbon steel, such as S45C or S55C, as stipulated in JIS, may be used for the raw material of the rotor 2 and the stator 3, which constitute the dispersing device 1. A ceramic, such as alumina, silicon nitride, zirconia, sialon, silicon carbide, or a tool steel, such as SKD or SKF, as stipulated in JIS, may be used. A metal such as a stainless steel on which a ceramic is thermal sprayed (for example, alumina thermal spraying or zirconia thermal spraying) may be used. By using the rotor and the stator that are made of a metal on which a ceramic is thermal sprayed, the life can be prolonged and any contamination by metal can be prevented.

By the process for dispersing in which the dispersing device 1 is used the mixture 4 is supplied between the rotor 2 and the stator 3 of the dispersing device 1 to cause the mixture 4 to flow toward the outer circumference by centrifugal force so that the mixture 4 is dispersed. By the dispersing device 1 and the process for dispersing, the yield is high, the dispersing power is high, and the dispersing process is carried out within an appropriate temperature range. That is, an appropriate dispersing process is carried out. By the dispersing device 1 and the process for dispersing, since the container 11 and the cover assembly 12 can be separated for cleaning after the dispersing process, the cleaning is easy.

Next, the dispersing system 51 that uses the dispersing device 1 is discussed. The dispersing system 51 as in FIG. 3 comprises the dispersing device 1, a tank 52 for storing a mixture before the process, a tank 53 for storing a mixture after the process, a first piping 54, and a second piping 55. The tank 52 for storing a mixture before the process stores the mixture 4 that is supplied to the dispersing device 1. The tank 53 for storing a mixture after the process stores the mixture 4 that has been dispersed by the dispersing device 1. The first piping 54 connects the dispersing device 1 with the tank 52 for storing a mixture before the process. The second piping 55 connects the dispersing device 1 with the tank 53 for storing a mixture after the process.

A pump 56 is provided on the first piping 54. The pump 56 supplies the mixture 4 in the tank 52 for storing a mixture before the process to the dispersing device 1, i.e., the port 33 for supplying the mixture of the dispersing device 1. A pump 57 is provided on the second piping 55. The second pump 57 supplies the mixture 4 in the container 11 of the dispersing device 1 to the tank 53 for storing a mixture after the process.

An agitator 52*c* that has a motor 52*a* and an agitating plate 52*b* is provided to the tank 52 for storing a mixture before the process. The agitator 52*c* agitates the mixture 4 before the process to preliminarily disperse it. For example, a part for supplying the liquid and a part for supplying the powder are provided to the tank 52 for storing a mixture before the process so that the liquid and the powder are supplied to the tank 52 to be agitated. That is, a preliminary dispersion can be carried out. The dispersing system 51 performs the preliminary dispersion by the agitator 52*c* and the dispersing process in a single dispersion by the dispersing device 1. Thus the efficiency in dispersing is high. An agitator 53*c* that has a motor 53*a* and an agitating plate 53*b* is provided to the tank 53 for storing a mixture after the process. The agitator 53*c* homogenizes the mixture 4 after being dispersed. A vacuum pump may be provided to the tank 53 and an on-off valve may be provided to the second piping 55. By using the vacuum pump, the on-off valve, and the agitator 53*c* the mixture 4 after being dispersed can be defoamed. If a contact seal, such as a lip seal, is provided to the dispersing device 1 instead of the on-off valve so that ambient air is prevented from entering, the mixture 4 is defoamed while it is being dispersed.

The dispersing system 51 disperses the mixture 4 by processing the mixture 4 that has been stored in the tank 52 for storing a mixture before the process by the dispersing device 1 and by supplying the dispersed mixture 4 to the tank 53 for storing a mixture after the process. The dispersing system 51 is suitable for a dispersing process in which the mixture passes between the rotor 2 and the stator 3 of the dispersing device 1 one time, namely, "in a single dispersion." By the dispersing process in a single dispersion no shortcut is generated so that no inhomogeneous dispersion occurs. Thus the system can be simplified and the cost for constructing the devices can be saved. Further, since the dispersing device 1 is included, the yield is good, the dispersing power is strong, and the dispersing process can be carried out within an appropriate temperature range. Namely, the appropriate dispersing process can be carried out.

Figure 6:
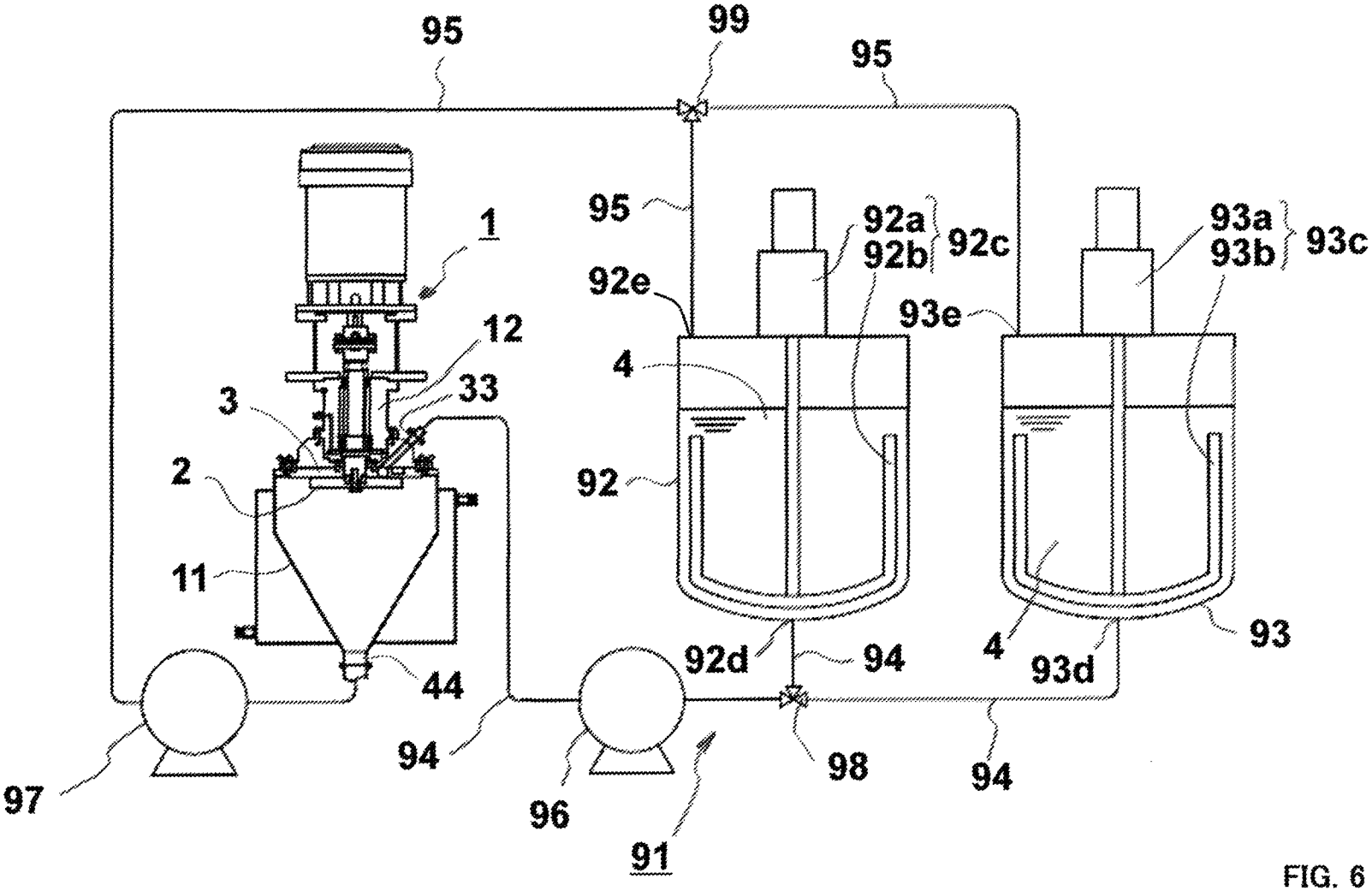
FIG. 6 shows a schematic drawing of another embodiment of the dispersing system, which embodiment is suitable for a dispersing process that uses multiple paths.
Figure 7:
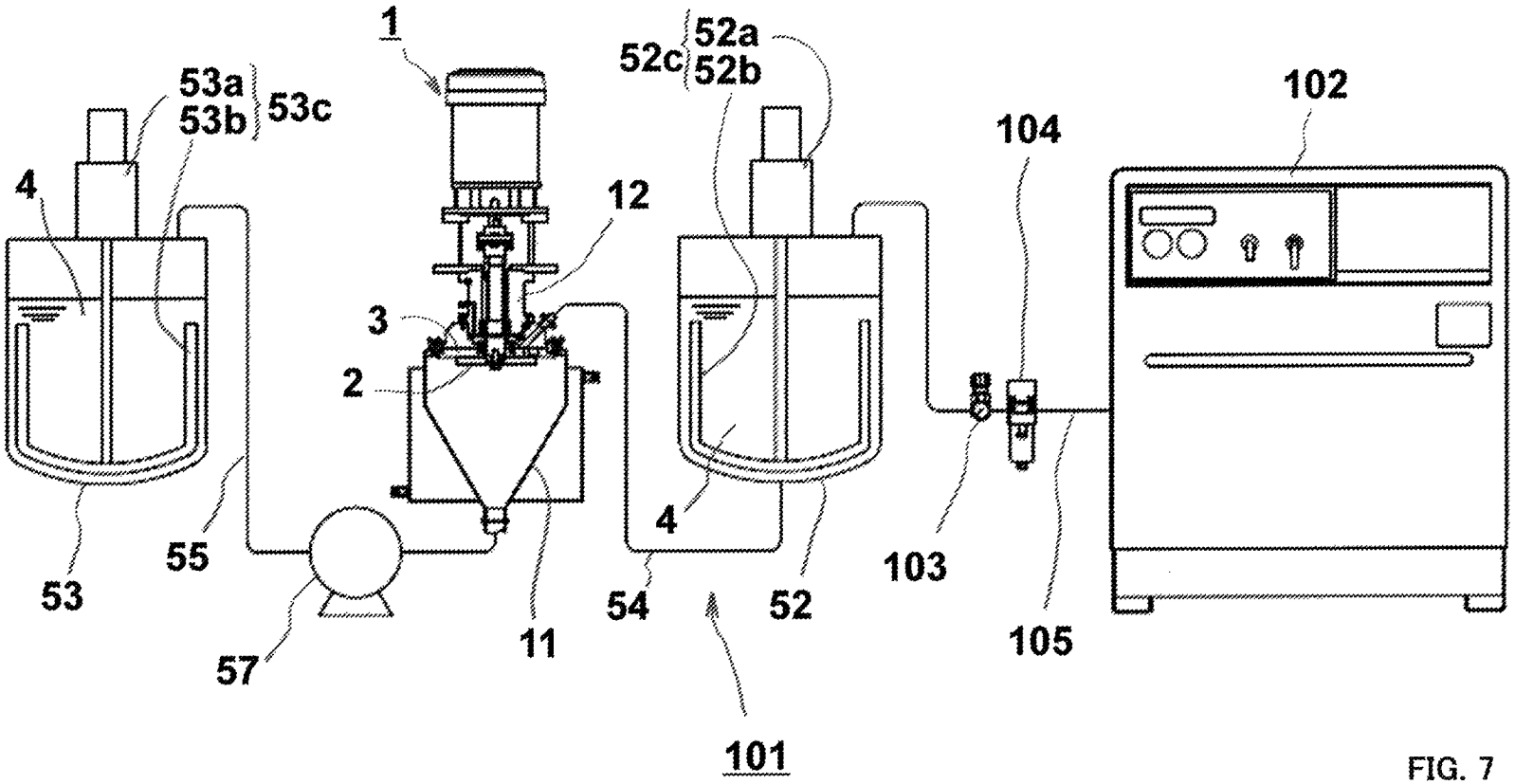
FIG. 7 shows a schematic drawing of yet another embodiment of the dispersing system, which embodiment uses air pressure for supplying the mixture.

The dispersing system that uses the dispersing device 1 is not limited to the dispersing system 51 as in FIG. 3, but may be, for example, the dispersing system 91 or the dispersing system 101 as in FIG. 6 or 7. The dispersing system 91 has the same structure and functions as the system 51 except that it may have multiple paths. The dispersing system 101 has the same structure and functions as the system 51 except that it supplies the mixture 4 to the dispersing device 1 by means of compressive force. So, a duplicate explanation is omitted.

The dispersing system 91 as in FIG. 6 comprises the dispersing device 1, a first tank 92, a second tank 93, a first piping 94, and a second piping 95. Respective first and second tanks 92, 93 can store both the mixture 4 to be supplied to the dispersing device 1 and the mixture 4 after it is dispersed by the dispersing device 1. That is, each of the first and second tanks 92, 93 has functions of both the tank 52 for storing a mixture before the process and the tank 53 for storing a mixture after the process. Agitating mechanisms 92*c*. 93*c* that consist of motors 92*a*. 93*a* and agitating plates 92*b*. 93*b* are provided to the first and second tanks 92, 93, respectively, so as to have the functions of the agitators 52*c*. 53*c*.

In the first piping 94 piping for the mixture 4 from a port 92*d* for discharging of the first tank 92 and piping for the mixture 4 from a port 93*d* for discharging of the second tank 93 join to supply the mixture 4 to the port 33 for supplying of the dispersing device 1. At the joined point a selector valve 98 is provided to the first piping 94.

In the second piping 95 piping for supplying the mixture 4 from the port 44 for discharging of the dispersing device 1 branches to supply the mixture 4 to an inlet (a port for supplying) 92*e* of the first tank 92 and to an inlet (a port for supplying) 93*e* of the second tank 93. At the branch a second selector valve 99 is provided to the second piping 95.

A pump 96 is provided to the first piping 94. The pump 96 supplies the mixture 4 in one of the first and second tanks 92, 93 that is connected by means of the first selector valve 98 to function as the tank for storing a mixture before the process to the dispersing device 1 (the port 33 for supplying the mixture of the device 1). A pump 97 is provided to the second piping 95. The pump 97 supplies the mixture 4 in the container 11 of the dispersing device 1 to one of the first and second tanks 92, 93 that is connected by means of the second selector valve 99 to function as the tank for storing a mixture after the process.

Namely, by the dispersing system 91 the first and second selector valves 98, 99 are switched so that the mixture 4 is supplied from either of the tanks 92, 93 through the first piping 94 to the dispersing device 1 to be dispersed and so that the mixture 4 after being processed is supplied to the other tank. By alternately switching between the tank that functions as the tank for storing a mixture before the process and the tank that functions as the tank for storing a mixture after the process, the mixture 4 is supplied to the dispersing device 1 multiple times to be dispersed. The dispersing system 91 enables a dispersing process in which the mixture passes between the rotor 2 and the stator 3 of the dispersing device 1 to be carried out multiple times, namely "in multiple dispersions."

Like the dispersing system 51, the dispersing system 101 as in FIG. 7 comprises the dispersing device 1, a tank 52 for storing a mixture before the process, a tank 53 for storing a mixture after the process, a first piping 54, and a second piping 55. Like the dispersing system 51, a pump 57 is provided to the second piping 55.

A compressor 102 is connected to the tank 52 for storing a mixture before the process of the dispersing system 101 via a flow control valve 103 and a filter 104. Namely, the flow control valve 103 and the filter 104 are provided to a piping 105 that connects the tank 52 for storing a mixture before the process with the compressor 102. The flow control valve 103 regulates the flow of compressed air from the compressor 102 to the tank 52. The filter 104 removes unwanted substances from the compressed air that is supplied from the compressor 102 to the tank 52.

By the dispersing system 101, a pressure applied by the compressor 102 and the flow control valve 103 on the mixture 4 in the tank 52 for storing a mixture before the process causes the mixture 4 to flow from the tank 52 through the first piping 54 to the dispersing device 1.

By the dispersing system 101, the mixture 4 that has been stored in the tank 52 for storing a mixture before the process is dispersed by the dispersing device 1 and the mixture 4 after being dispersed is supplied to the tank 53 for storing a mixture after the process. Thus the mixture 4 is dispersed.

The dispersing system 101 is suitable for a dispersing process "in a single dispersion."

As discussed above, since both the dispersing system 91 and the dispersing system 101 include the dispersing device 1, the yield is good, the dispersing power is strong, and the dispersing process can be carried out within an appropriate temperature range. Namely, an appropriate dispersing process can be carried out. Incidentally, the dispersing device 1 may constitute a circulating-type dispersing system with a pump for circulation, a piping for circulation, and a tank that is provided to the piping.

Figure 8:
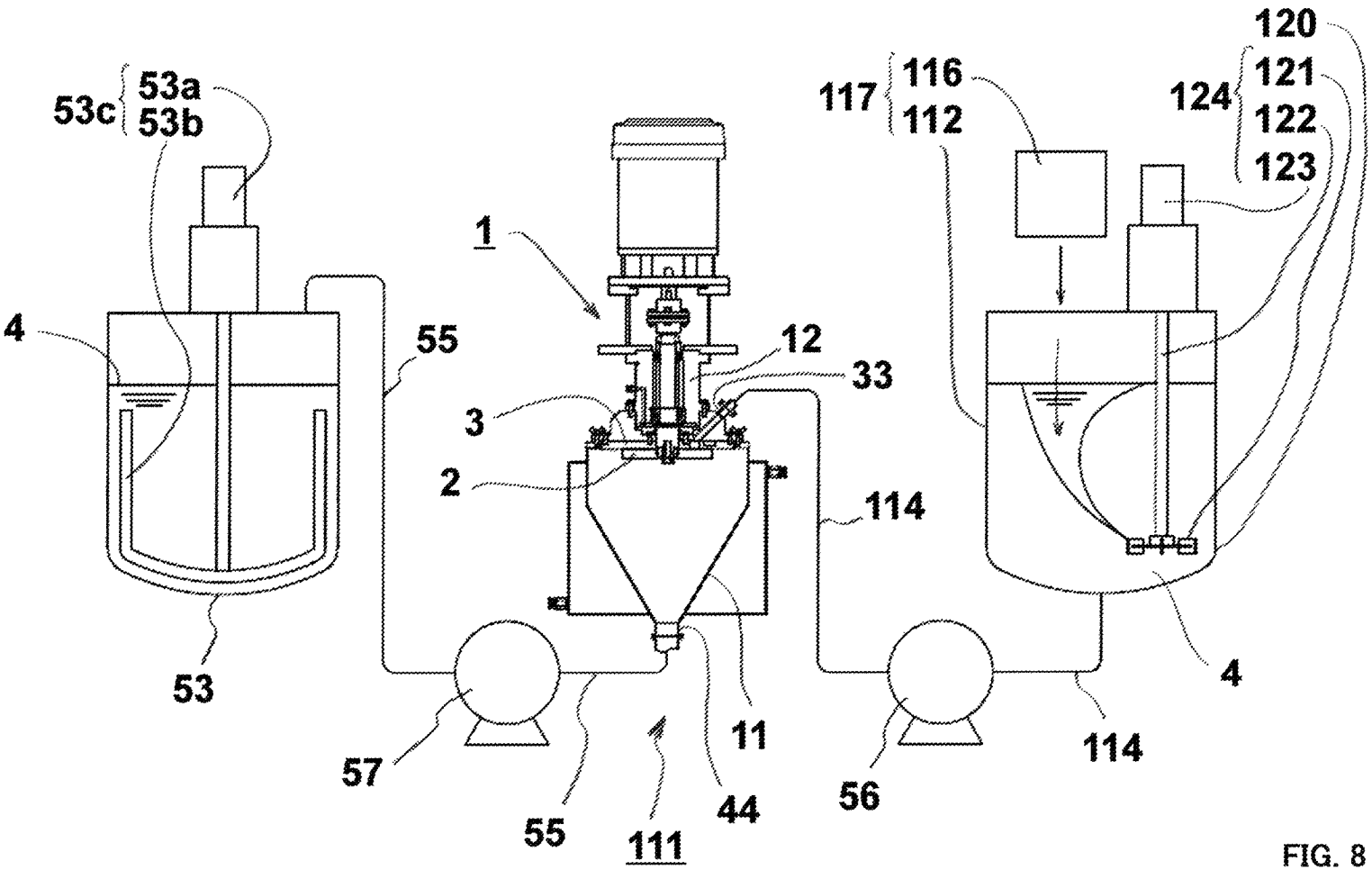
FIG. 8 shows a schematic drawing of yet another embodiment of the dispersing system, where the capability for preliminary dispersion is enhanced.

Next, a dispersing system 111 as in FIG. 8 is discussed as another example of a dispersing system that uses the dispersing device 1. The dispersing system 111 is characterized in that it has a tank 112 for agitation that has a high capability for preliminary dispersion. The system 111 has the same structure and functions as the dispersing system 51 except that the tank 112 for agitation is provided instead of the tank 52 for storing a mixture before the process of the dispersing system 51 as in FIG. 3. So, a duplicate explanation is omitted.

The dispersing system 111 as in FIG. 8 comprises the dispersing device 1, the tank 112 for agitation, the tank 53 for storing a mixture after the process, the first piping 114, the second piping 55, and a mechanism 116 for supplying. Like the first piping 54 as in FIG. 3, a pump 56 is provided to the first piping 114. A pump 57 is provided to the second piping 55.

The tank 112 for agitation stores the mixture 4 that is supplied to the dispersing device 1 and agitates (preliminarily disperses) it. The mechanism 116 for supplying supplies powdery additives that constitute the mixture 4 to the tank 112. The first piping 114 connects the dispersing device 1 with the tank 112. The tank 53 for storing a mixture after the process stores the mixture 4 that has been dispersed by the dispersing device 1. The second piping 55 connects the dispersing device 1 with the tank 53.

The tank 112 and the mechanism 116 function as a preliminary dispersing device 117. Namely, the preliminary dispersing device 117 stores slurry or liquid raw material, supplies powdery additives that are to be mixed with the raw material, and preliminarily disperses the raw material and additives (preliminary dispersion prior to the dispersing process by the dispersing device 1).

The tank 112 for agitation has a tank 120, an agitating blade 121, a rotary shaft 122 that is connected to the agitating blade 121, and a motor 123 that rotates the rotary shaft 122. The motor 123, the agitating blade 121, and the rotary shaft 122 constitute a mechanism 124 for agitation. The rotary shaft 122 is eccentrically located outside the center of the tank 120 (off-center) so that the rotation of the agitating blade 121 generates an inclined vortex. Incidentally, the tank 120 has a cylindrical wall and a curved bottom plate. However, it is not limited to this structure.

Figure 9:
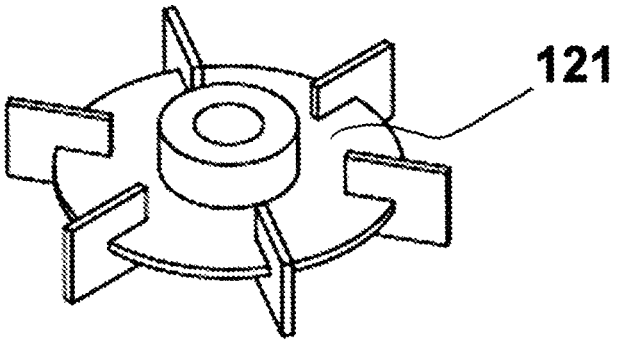
FIG. 9 shows some examples of agitating blades that are suitable to be used in a tank for agitation that is a part of the dispersing system in FIG. 8. Figure (a) is a perspective view of disc turbine-type agitating blades. Figure (b) is a perspective view of dissolver-type (dispersing-type) agitating blades. Figure (c) is a perspective view of propeller-type agitating blades.
Figure 9:
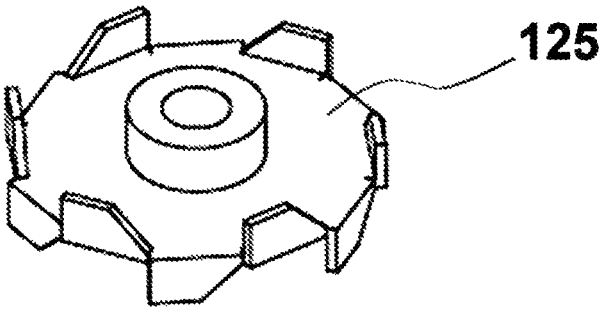
Figure 9:
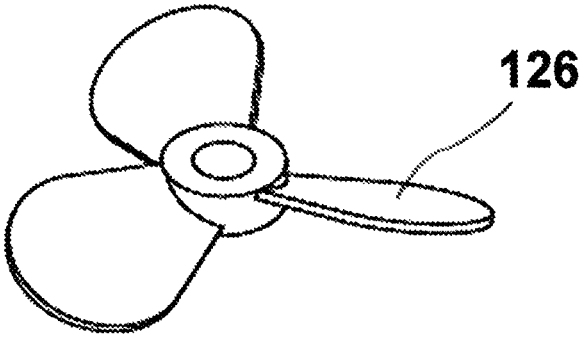

The agitating blade 121 is, for example, a turbine-type such as a disk turbine-type impeller as in FIG. 9(*a*). The agitating blade 121 generates an inclined vortex in the slurry or liquid mixture 4 (a raw material at first) in the tank 120. The agitating blade that constitutes the tank 112 for agitation is not limited to it, but may be any one that generates an inclined vortex, such as an agitating blade 125, which is a dissolver-type impeller as in FIG. 9(*b*), or an agitating blade 126, which is a propeller-type impeller as in FIG. 9(*c*).

The mechanism 116 for supplying supplies powdery additives to the inclined vortex that is generated by the agitating blade 121. For example, the mechanism 116 for supplying is a vibration-type fixed quantity feeder. The mechanism 116 for supplying is not limited to it, but may be any other vibration-type feeder or a screw-type feeder. The powder that is supplied to the inclined vortex is prevented from becoming a large lump. Thus a problem caused by clogging in the tank 120 or the piping or adhering to them is prevented so that an appropriate dispersion can be carried out by the dispersing device 1. Since the agitating blade 121 is configured to rotate at an off-center position, a wide space for the mechanism 116 for supplying is ensured. Namely, the amount of powder that adheres to the rotary shaft 122 of the agitating blade 121 can be reduced. That effect also contributes to a high accuracy of the compositions of the mixture 4.

By the dispersing system 111, the mixture 4 that has been agitated by the tank 112 for agitation is dispersed by the dispersing device 1 and the dispersed mixture 4 is supplied to the tank 53 for storing a mixture after the process. By the process for dispersing that uses the dispersing system 111, the mixture 4 is agitated by the tank 112 for agitation and the mixture 4 that has been agitated by the tank 112 is supplied to a gap between the rotor 2 and the stator 3 of the dispersing device 1, to cause the mixture 4 to flow toward the outer circumference by centrifugal force. The dispersed mixture 4 is supplied through the second piping 55 to the tank 53 for storing a mixture after the process so that it is agitated by the tank 53 to be prevented from becoming inhomogeneous. By the dispersing system 111 or the process for dispersing, the yield is good, the dispersing power is strong, and the dispersing process can be carried out within an appropriate temperature range. Namely, an appropriate dispersing process can be carried out.

The preliminary dispersing device 117 and the dispersing system 111 as discussed above are suitable for dissolving powder such as CMC (carboxymethylcellulose) with water. The CMC is used for a binder for the raw material of a battery. It must be used as the water solution. It is hard to mix it with water (a low hydrophilic property) and thus making the water solution takes a long time. One of the reasons is that, when the anchor-type agitating blade is used as the tank 52 as in FIG. 3, the powder floats on the water and is hardly dissolved in it.

In contrast, the preliminary dispersing device 117, which has the tank 112 for agitation and the mechanism 116 for supplying as discussed above, generates an inclined vortex in the liquid or slurry in the tank. Thus by supplying powder into the inclined vortex from the mechanism 116 for supplying, the powder is forced to be mixed with the liquid, e.g., water, or the slurry, by a sucking force caused by the vortex. The powder that has been mixed reaches the part for agitation of the agitating blade 121 so that agglomerated particles are broken down. In this way the preliminary dispersing device 117 appropriately agitates (preliminarily disperses) powder of a low hydrophilic property, such as CWC, in a short time.

The tank 112 for agitation and the preliminary dispersing device 117 are compatible with the dispersing device 1. If powder of a low hydrophilic property were to be mixed with liquid only by the tank 112 for agitation (the preliminary dispersing device 117), a blade that has a strong dispersing power would be needed. Further, processing it would take a long time, and conditions to form a good vortex (the number of rotations, the offset of the rotary shaft, the amount of the liquid or slurry in the tank, and the rate to supply the powder) would be strictly determined. In contrast, since the dispersing system 111 as in FIG. 8 includes the tank 112 for agitation (the preliminary dispersing device 117) and the dispersing device 1, an appropriate dispersion can be carried out in a short time.

By the dispersing system 111, if agglomerated particles of some hundreds μm to some mm remain in the tank 112 for agitation, the agglomerated particles are broken down by a strong sheer force caused by the dispersing device 1 so that the uniform mixture 4 can be obtained. Further, the dispersing process may be completed in a single dispersion. Thus a processing time can be drastically shortened. From the viewpoint of a system having the dispersing device 1, the preliminary dispersing device 117 has a merit of carrying out a preliminary dispersion in a short time. By including the preliminary dispersing device 117 and the dispersing device 1 together, it is especially advantageous for mixing (dispersing) powder of a low hydrophilic property with a liquid (water) or slurry.

The mixture 4, e.g., an aqueous solution, that has been dispersed by the dispersing device 1, is pumped by the pump 57 to the tank 53 for storing a mixture after the process. There a mixing process to prevent an inhomogeneous concentration is carried out. In that process the entire content of the tank 53 must be agitated. If the mixture, e.g., CMC, is viscous, an anchor-type agitating blade as in the tank 53 is appropriately used.

As discussed above, the dispersing system 111 enables an appropriate dispersion to be carried out in a short time by including the tank 112 for agitation and the preliminary dispersing device 117 even when powder (additives) of a low hydrophilic property, e.g., CMC, is mixed with a raw material. Further, the dispersing system 111 has advantageous effects that are caused by the dispersing device 1, namely, the same effects as those of the dispersing system 51 as in FIG. 3. That is, the yield is good, the dispersing power is strong, and the dispersing process can be carried out within an appropriate temperature range. Namely, the appropriate dispersing process can be carried out.

Next, a dispersing system 151, which is a variation of the dispersing system 111 as in FIG. 8, is discussed with reference to FIG. 10. The dispersing system 151 is characterized in that the container of the dispersing device 1 is directly connected to the tank 53 for storing a mixture after the process and is shaped so as to smoothly supply the mixture 4 to the tank 53. The system 151 has the same structure and functions as the dispersing system 111 except that the second piping 55 is eliminated and a container 161 is provided instead of the container 11. So, a duplicate explanation is omitted. Below, for easy understanding a dispersing device in which the container 11 of the dispersing device 1 is replaced by the container 161 is called "the dispersing device 160." The dispersing device 160 has the same structure and functions as the dispersing device 1 except that it includes the container 161 instead of the container 11. The container 161 can be used in the dispersing system 111 as in FIG. 3. If it is so used, the effects that are discussed below with reference to the dispersing system 151 can be obtained.

Figure 10:
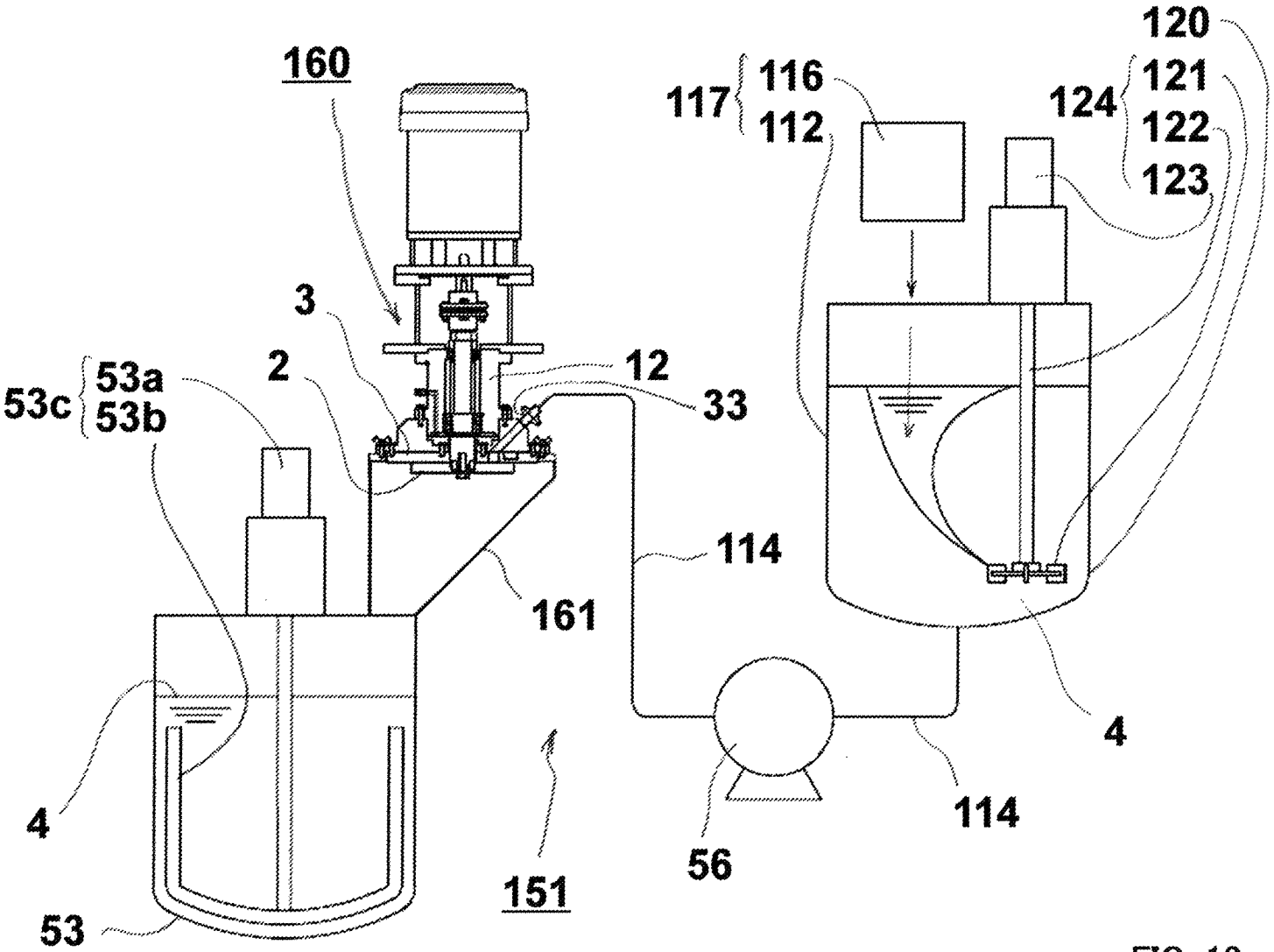
FIG. 10 shows a schematic drawing of yet another embodiment of the dispersing system that uses a dispersing device that achieves a better rate of collecting the mixture and where the capability for preliminary dispersion is enhanced.

The dispersing system 151 as in FIG. 10 comprises the dispersing device 160 having the container 161, a tank 112 for agitation, a mechanism 116 for supplying, a tank 53 for storing a mixture after the process, and a first piping 114. A pump 56 is provided to the first piping 114.

The container 161 of the dispersing device 160, which device constitutes the dispersing system 151, has a wall that makes the cross section smaller as it becomes lower. It is connected to the upper portion of the tank 53 for storing a mixture after the process. In this embodiment it is integrated with a top cover of the tank 53. However, it may be configured to be tied (detachably tied) to it by a connecting member, such as a flange. Alternatively, it does not need to be tied, but can be connected by inserting a part of it into a hole that is formed in the tank 53. The container 161 may be shaped so that the cross section is placed near one side as it becomes lower. Thus connecting the container 161 to the tank 53 is facilitated. However, its shape is not limited to those shapes. The container 161 also functions to supply the mixture 4 that has been dispersed by the rotor 2 and the stator 3 to the tank 53.

By the dispersing system 151 the mixture 4 after being agitated by the tank 112 for agitation is dispersed by the dispersing device 160. The dispersed mixture 4 is directly supplied to the tank 53 for storing a mixture after the process. By the process for dispersing that uses the dispersing system 161 the mixture 4 is agitated by the tank 112 for agitation. The agitated mixture 4 is supplied to a gap between the rotor 2 and the stator 3 of the dispersing device 160 so that it is caused to flow toward the outer circumference by centrifugal force, to be dispersed. The mixture 4 that has been dispersed by the dispersing device 160 is directly supplied to the tank 53 for storing a mixture after the process through the container 161. There it is agitated so that the mixture 4 as a whole is prevented from becoming inhomogeneous. By the dispersing system 151 and the process for dispersing, the yield is good, the dispersing power is strong, and the dispersing process can be carried out within an appropriate temperature range. Namely, the appropriate dispersing process can be carried out.

As discussed above, since the dispersing system 151 includes the preliminary dispersing device 117 having the tank 112 for agitation, it enables an appropriate dispersion to be carried out in a short time, like the dispersing system 111, even when powder (additives) of a low hydrophilic property, e.g., CMC, is mixed with a raw material. The second piping 55 and some elements in the piping 55, such as the pump 57, can be eliminated in the dispersing system 151 in comparison with the dispersing system 111. Thus, since no mixture adheres to the insides of the elements and remains in them, the dispersed mixture 4 can be prevented from being reduced. That is, the rate of collection of the dispersed mixture 4 significantly increases. These effects work well with the effects of the increased rate of collection of the dispersed mixture 4 by the dispersing device 160. Further, the dispersing system 151 has the same effects as those caused by having the dispersing device 160 (the dispersing device 160 has the same effects as the dispersing device 1), namely, the same effects as the dispersing system 51 as in FIG. 3. That is, the yield is good, the dispersing power is strong, and the dispersing process can be carried out within an appropriate temperature range. Namely, the appropriate dispersing process can be carried out.

Below, the main reference numerals and symbols that are used in the detailed description and drawings are listed.

1 the dispersing device
2 the rotor
3, 76, 77 the stator
4 the mixture
11 the container
12 the cover assembly
13 the rotary shaft (for rotating the rotor)
14 the bearing
15 the spacer
15*a* the first through-hole
15*b* the second through-hole
17 the part for holding the bearing

18 the part for holding the stator
20 the second spacer
21 the part for controlling the axial position
22 the concave part
22*a* the through-hole
23 the fastening member
24 the pin
26, 71, 72 the groove for cooling
27, 73, 74 the wall
28 the port for supplying the coolant
29 the port for discharging the coolant
31 the hole for inserting the rotary shaft
32 the through-hole (for supplying the mixture)
33 the port for supplying the mixture
34 the passage
36 the second hole for inserting the rotary shaft
37 the seal
41 the cooling mechanism
44 the port for discharging
51, 91, 101, 111 the dispersing system
52 the tank for storing a mixture before the process
52*b*. 53*b* the agitating plate
53 the tank for storing a mixture after the process
54, 94, 114 the first piping
55, 95 the second piping
92 the first tank
93 the second tank
98 the first selector valve
99 the second selector valve
102 the compressor
103 the flow control valve
112 the tank for agitation
116 the mechanism for supplying
120 the tank
121, 125, 126 the agitating blade
122 the rotary shaft

The invention claimed is:

1. A shear-type dispersing device for dispersing a mixture of a slurry or a liquid by causing the mixture to flow by centrifugal force toward an outer circumference between a rotor, and a stator that is disposed to face the rotor, comprising:

a container for receiving the dispersed mixture;

a cover assembly that closes an upper opening of the container;

a stator that is fixed under the cover assembly;

a rotor that is disposed to face a lower surface of the stator;

a rotary shaft that rotates the rotor;

a bearing that is disposed in the cover assembly and is located above the stator to rotatably hold the rotary shaft; and a spacer that is detachably disposed between the rotary shaft and the rotor to adjust a gap between the rotor and the stator;

wherein when the spacer is disposed an axial position of the rotor in relation to the stator is fixed, wherein the cover assembly has a part for holding the bearing and a part for holding the stator that is disposed under the part for holding the bearing, wherein the part for holding the bearing has a part for controlling an axial position that controls the axial position of the part for holding the stator by abutting the part for holding the stator by means of a second spacer, wherein the second spacer is detachably disposed between the part for holding the bearing and the part for holding the stator to adjust the axial position of the stator in relation to the part for holding the bearing by being replaced by another second spacer that has a different axial length, wherein a concave part is formed on an upper surface of the rotor so that a lower end, of the rotary shaft is inserted thereto, wherein a through-hole opens on the concave part, wherein the lower end of the rotary shaft is inserted into the concave part of the rotor so that a fastening member is fixed from a lower side of the rotor while the lower end abuts the concave part across the spacer, wherein the fastening member fastens the rotary shaft to the rotor across the spacer by fixing a part thereof to the rotary shaft through the through-hole in the rotor, wherein pins are inserted into the concave part of the rotor and the lower end of the rotary shaft to transmit a rotational power of the rotary shaft to the rotor, the pins being disposed at uniform intervals along a circumferential direction, and wherein a first through-hole through which the fastening member passes and second through-holes through which the pins pass are formed in the spacer.

2. The dispersing device of claim 1, wherein the stator is bigger than the rotor on a plane where the stator faces the rotor, wherein in the stator a groove for cooling is formed on a surface opposite the surface that faces the rotor, and wherein the groove for cooling is formed beyond an outer edge of the rotor.

3. The dispersing device of claim 2, wherein a wall is formed along a radial direction on the groove for cooling, wherein a port for supplying coolant and a port for discharging the coolant are disposed across the wall, and wherein the coolant that is supplied from the port for supplying the coolant flows toward a direction in which no wall is formed near the port for supplying the coolant, in the circumferential direction, the coolant being discharged from the port for discharging the coolant.

4. The dispersing device of claim 2, wherein in the stator a hole for inserting the rotary shaft is formed, and wherein the mixture is supplied from outside the hole for inserting the rotary shaft to the gap between the stator and the rotor.

5. The dispersing device of claim 4, wherein in the stator a through-hole for supplying the mixture is formed outside the hole for inserting the rotary shaft, wherein in the part for holding the stator a port for supplying the mixture, and a passage that communicates with the port for supplying the mixture to the through-hole for supplying the mixture in the stator, are provided, and wherein the mixture that is supplied from the port for supplying the mixture is introduced to the gap between the stator and the rotor through the passage in the part for holding the stator and the through-hole in the stator.

6. The dispersing device of claim 5, wherein a second hole for inserting the rotary shaft is formed in the part for holding the stator, wherein a labyrinth seal is provided to the second hole for inserting the rotary shaft, and wherein air is supplied from outside the part for holding the stator to a space that is located within the part for holding the stator and connected to an upper part of the second hole for inserting the rotary shaft.

7. The dispersing device of claim 6, wherein a cooling mechanism is provided to the container.

8. The dispersing device of claim 7, wherein the container has a conical wall that is shaped as a cone that has a smaller cross section from a top to a bottom, wherein a port for discharging the mixture that has been dispersed is provided at a lower end of the container, and wherein the container is equipped with an agitator that scrapes a slurry mixture that adheres to the wall of the container.

9. The dispersing device of claim 8, wherein the stator and the rotor are made of stainless steel on which a ceramic is thermal sprayed.

10. The dispersing device of claim 2, wherein the container doubles as a tank for storing the mixture after being dispersed.

11. A dispersing system comprising:

the dispersing device of claim 1;

a tank for storing a mixture before a process that stores the mixture to be supplied to the dispersing device;

a tank for storing a mixture after the process that stores the mixture that has been processed by the dispersing device;

a first piping that connects the dispersing device with the tank for storing the mixture before the process; and a second piping that connects the dispersing device with the tank for storing the mixture after the process;

wherein the mixture that has been stored in the tank for storing the mixture before the process is processed by the dispersing device, and the mixture that has been processed is supplied to the tank for storing the mixture after the process.

12. The dispersing system of claim 11, wherein a compressor is connected to the tank for storing the mixture before the process via a flow control valve, wherein a pressure applied by the compressor and the flow control valve on the mixture in the tank for storing the mixture before the process causes the mixture to flow from the tank for storing the mixture before the process to the dispersing device through the first piping.

13. A dispersing system comprising:

the dispersing device of claim 1;

first and second tanks, each of which can store the mixture to be supplied to the dispersing device and the mixture that has been dispersed by the dispersing device;

a first piping in which a piping for the mixture from the first tank and a piping for the mixture from the second tank join to supply the mixture to the dispersing device and to which a first selector valve is provided at a point where the piping joins; and a second piping in which a piping for the mixture from the dispersing device branches to supply the mixture to the first and second tanks and to which a second selector valve is provided at a point where the piping branches;

wherein the first and second selector valves are switched so that the mixture is supplied from either of the first and second tanks through the first piping to the dispersing device to be dispersed, and so that the mixture after being dispersed is supplied to the other tank, and wherein the mixture is dispersed multiple times by alternately switching between the first and second tanks.

14. A dispersing system comprising:

the dispersing device of claim 1;

a tank for agitation that agitates the mixture to be supplied to the dispersing device;

a mechanism for supplying that supplies powdery additives that constitute the mixture to the tank for agitation; and a first piping that connects the dispersing device with the tank for agitation;

wherein the tank for agitation has a rotary shaft that is eccentrically located and an agitating blade that is connected to the rotary shaft so as to generate an inclined vortex;

wherein the mechanism for supplying supplies the powdery additives to the inclined vortex that is generated by the agitating blade; and wherein the mixture that has been agitated by the tank for agitation is dispersed by the dispersing device.

15. The dispersing system of claim 14 further comprising:

a tank for storing a mixture after the process that stores the mixture that has been dispersed by the dispersing device; and a second piping that connects the dispersing device with the tank for storing a mixture after the process;

wherein the mixture that has been agitated by the tank for agitation is dispersed by the dispersing device, and wherein the dispersed mixture is supplied to the tank for storing a mixture after the process.

16. A dispersing system comprising:

the dispersing device of claim 1;

a tank for agitation that stores the mixture to be supplied to the dispersing device and agitates the mixture;

a mechanism for supplying that supplies powdery additives that constitute the mixture to the tank for agitation;

a tank for storing a mixture after the process that stores the mixture that has been processed by the dispersing device; and a piping that connects the dispersing device with the tank for agitation;

wherein the tank for agitation has a rotary shaft that is eccentrically located and an agitating blade that is connected to the rotary shaft so as to generate an inclined vortex;

wherein the mechanism for supplying supplies the powdery additives to the inclined vortex that is generated by the agitating blade; and wherein the container has a conical wall that is shaped as a cone that has a smaller cross section from a top to a bottom, and is connected to an upper part of the tank for storing a mixture after the process so as to supply the mixture that has been dispersed by the rotor and the stator to the tank for storing a mixture after the process, and wherein the mixture that has been agitated by the tank for agitation is dispersed by the dispersing device and the dispersed mixture is supplied to the tank for storing a mixture after the process.

17. A process for dispersing that uses the dispersing device of claim 1, comprising:

a step of supplying the mixture between the rotor and the stator of the dispersing device so as to cause the mixture to flow toward an outer circumference by centrifugal force.

* * * * *